US009283578B2

(12) United States Patent
Kim et al.

(10) Patent No.: US 9,283,578 B2
(45) Date of Patent: Mar. 15, 2016

(54) DISPENSING DEVICE FOR BOTH FROTH AND NON-FROTH COATINGS

(75) Inventors: Eung Kyu Kim, Midland, MI (US); Thomas J. Parsons, Freeland, MI (US); Laura J. Dietsche, Midland, MI (US); Michael D. Bowe, Doylestown, PA (US); Janah C. Szewczyk, Philadelphia, PA (US)

(73) Assignees: Dow Global Technologies LLC, Midland, MI (US); Rohm and Haas Company, Philadelphia, PA (US)

( * ) Notice: Subject to any disclaimer, the term of this patent is extended or adjusted under 35 U.S.C. 154(b) by 219 days.

(21) Appl. No.: 13/634,150

(22) PCT Filed: Apr. 5, 2011

(86) PCT No.: PCT/US2011/031177

§ 371 (c)(1), (2), (4) Date: Sep. 11, 2012

(87) PCT Pub. No.: WO2011/130053

PCT Pub. Date: Oct. 20, 2011

(65) Prior Publication Data

US 2013/0022751 A1 Jan. 24, 2013

Related U.S. Application Data

(60) Provisional application No. 61/323,911, filed on Apr. 14, 2010.

(51) Int. Cl.
*B05B 7/04* (2006.01)
*B05B 7/00* (2006.01)

(Continued)

(52) U.S. Cl.
CPC ..... *B05B 7/0043* (2013.01); *B01F 3/04446* (2013.01); *B01F 5/0696* (2013.01); *B05B 7/0441* (2013.01)

(58) Field of Classification Search
CPC B05B 7/0441; B05B 7/0043; B05B 3/04446; B05B 5/0696
USPC ..... 239/428.5, 526, 527, 398, 407, 417.5
See application file for complete search history.

(56) References Cited

U.S. PATENT DOCUMENTS 2,864,714 A * 12/1958 Dixon, Jr. et al. ..... 106/677
3,388,868 A 6/1968 Watson et al.

(Continued)

FOREIGN PATENT DOCUMENTS

| | | |
|---|---|---|
| FR | 2942152 | 8/2010 |
| JP | H07232107 A | 9/1995 |
| JP | H1085690 A | 4/1998 |

*Primary Examiner* — Jason Boeckmann
(74) *Attorney, Agent, or Firm* — Andrew E. C. Merriam

(57) ABSTRACT

A dispensing device (10) capable of dispensing both frothed and non-frothed liquids, the dispensing device having in order a fluid transport medium (20) defining a flow channel (25), a trigger controlled liquid flow regulator (30) defining a flow channel (35) through which fluid may flow when the trigger (37) is in one position but not when the trigger is in another position, a flow block (50) defining a flow channel (55) in fluid communication with a gas channel (65) and removably attached to the flow regulator, a flow restriction orifice (40) between the flow block and the flow regulator (30), a mixing block (70) defining a flow channel (75) containing mixing elements and optionally stabilization (80) and extension blocks each containing a flow channel (85) wherein each flow channel is in fluid communication with one another.

16 Claims, 2 Drawing Sheets

(51) Int. Cl.
*B01F 3/04* (2006.01)
*B01F 5/06* (2006.01)

(56) References Cited

U.S. PATENT DOCUMENTS 3,567,116 A * 3/1971 Lindlof ..... 239/14.2
3,701,482 A * 10/1972 Sachnik ..... 239/590.3
4,006,845 A 2/1977 Scholl et al.
4,207,202 A 6/1980 Cole, Jr.
4,396,529 A 8/1983 Price et al.
4,396,539 A 8/1983 Sapienza et al.
4,474,680 A 10/1984 Kroll
4,925,109 A * 5/1990 Flanagan et al. ..... 239/429
5,085,371 A 2/1992 Paige
5,364,031 A 11/1994 Taniguchi et al.
5,492,655 A 2/1996 Morton et al.
6,010,083 A 1/2000 Roe et al.
6,042,089 A 3/2000 Klein
6,422,734 B1 7/2002 Sethuraman et al.
7,086,612 B2 8/2006 Crawford
2001/0042761 A1 11/2001 Ophardt et al.
2006/0151634 A1 * 7/2006 Pivovarov ..... 239/526
2007/0186813 A1 8/2007 Smith
2008/0061166 A1 3/2008 Jacques et al.
2009/0107611 A1 4/2009 Bowe et al.
2009/0139181 A1 6/2009 Bowe et al.

* cited by examiner

DISPENSING DEVICE FOR BOTH FROTH AND NON-FROTH COATINGS

CROSS REFERENCE STATEMENT

This application claims the benefit of U.S. Provisional Application No. 61/323,911, filed Apr. 14, 2010, which is incorporated herein by reference.

BACKGROUND OF THE INVENTION

1. Field of the Invention

The present invention relates to a dispensing device for applying coatings as either froth foams or non-foamed spray coatings and a method for using the dispensing device.

2. Description of Related Art

House wraps enjoy popularity in the building industry for sealing structures from outside environmental effects such as moisture and wind. Typical house wrap materials are in the form of sheet materials that are stapled to a structural substrate and physically wrapped around a structure and cut away from window and door openings. A recent development has provided an alternative house wrap material in the form of a liquid building wrap (LBW). See for example, United States patent application publications 2009/0107611 and 2009/0139181. LBWs are desirable over conventional house wrap sheets because they apply easily without a need to staple into place, cut away from window and door openings and do not suffer from potentially blowing off from a structure under high winds.

The most effective application of a LBW includes two steps. The first step is to apply sealant froth foam to gaps, cracks and joints in a substrate structure. The froth foam fills and seals the gaps, cracks and joints. The second step is to apply a spray overcoat of a non-foamed film-forming fluid over the froth foam and remainder of the substrate structure to form a protective film over the outer surface of the structure. This second step seals off the structural surface from moisture and air penetration through the substrate structure. These two steps currently require two different types of application equipment. Application of the froth foam requires foaming equipment. Application of the non-foamed film-forming fluid requires paint or coating spray, roller or brush equipment. Requiring two types of equipment to apply the LBW is costly and technically undesirable because a worker must own, transport and care for two different pieces of equipment.

It would be desirable to have a single piece of equipment that can apply both the froth foam and the film-forming fluid of a LBW application.

BRIEF SUMMARY OF THE INVENTION

The present invention offers a solution to the problem of providing a single piece of equipment that can apply both the froth foam and the film-forming fluid during application of a LBW. Surprisingly, the present invention is able to take advantage of those components that are the same in both pieces of equipment and allows for removal of those components that are necessary only for the froth foam application. Therefore, the present invention allows easy application of LBW with a single device for both the froth foam component and the liquid film-forming component.

In a first aspect, the present invention is a dispensing device comprising in order the following members that together define a single flow channel through the dispensing device: (a) a fluid transport medium defining a flow channel through which liquid can be pumped; (b) a trigger controlled liquid flow regulator defining a flow channel in fluid communication with the flow channel of the fluid transport medium, where one end of the flow regulator and its flow channel is attached to the fluid transport medium and through which fluid may flow when the trigger is in one position and liquid cannot flow when the trigger is in another position; (c) a flow block defining a flow channel in fluid communication with the flow channel of the flow regulator and removably attached to the flow regulator, the flow block further defining a gas channel fluidly connecting the flow channel to an inlet through which gas can be introduced under pressure to a fluid flowing through the flow channel; (d) a flow restriction orifice either defined in the flow channel of the flow block or held in place as a distinct piece in the flow channel at the end of the flow regulator, at the start of the flow block or between the flow block and flow regulator, the flow restriction orifice having an opening that is smaller in cross sectional area than the flow channel downstream from it in the flow block; (e) a mixing block defining a flow channel in fluid communication with the flow channel of the flow block, the mixing block flow channel containing mixing elements; (f) optionally, a stabilization block defining a flow channel in fluid communication with the flow channel of the mixing block where the flow channel in the stabilization block is characterized by an absence of step changes in cross sectional dimensions and by inducing a gradual pressure drop along its length in a fluid being pumped through the flow channel of the dispensing device; and (g) optionally, an extension block defining a flow channel in fluid communication with the flow channel of the stabilization block.

Where the dispensing device further comprises an extension block, the stabilization block of the dispensing device defines a flow channel of sufficient dimensions and shape such that foaming of a liquid through the flow channel is completed prior to exiting the stabilization block.

In a second aspect, the present invention is a process for dispensing both foamed fluid and non-foamed fluid using the dispensing device of claim 1, the method comprising the following steps: (i) pumping a foamable fluid through the flow channel of each of (a)-(e), (f) if present and (g) if present, while simultaneously injecting gas into the foamable fluid through the gas channel of the flow block to form a foamable fluid composition; (ii) dispensing the foamable fluid composition as foam onto a substrate; (iii) disconnecting the removably attached flow block from the flow regulator; (iv) optionally removably attaching a spray nozzle to the flow regulator (a); and (v) pumping a second fluid through the flow regulator and, if present, spray nozzle and dispensing the fluid onto a surface.

The device of the present invention is useful for applying foamed and non-foamed liquids, including those of a LBW using the process of the present invention.

DETAILED DESCRIPTION OF THE INVENTION

Figure 1:
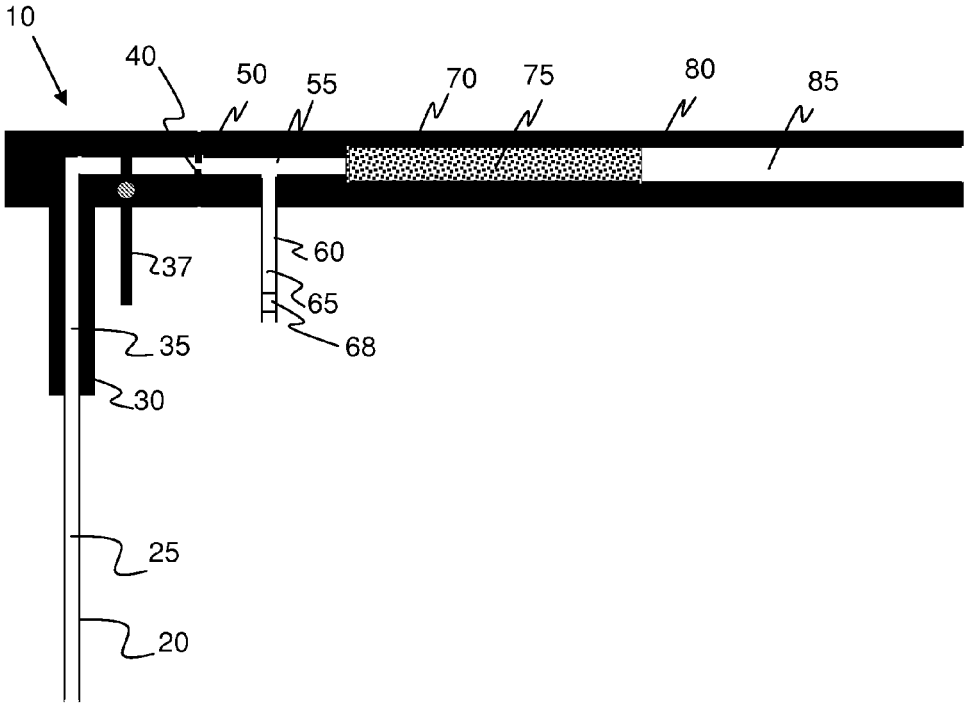
FIG. 1 illustrates a general cross sectional view of an embodiment of the dispensing device of the present invention.

"Fluid" and "liquid" herein refers to a pumpable material with fluid-like properties. A fluid can be a formulation of solids dispersed within a fluid or solid that flows and is pumpable like a fluid.

The dispensing device of the present invention defines as a whole a flow channel through the entire device through which a fluid is pumped for dispensing. The dispensing device desirably contains a single flow channel through the entire device, distinguishing it from 2-component dispensing devices that contain flow channels for each component. Depending on the configuration of the dispensing device the fluid is either foamed and dispensed as a foam or is not foamed and is dispensed as a coating by spraying, rolling or brushing. Each component of the dispensing device defines a portion of the flow channel that is in fluid communication with the flow channel of each of the other portions of the device. With the exception of the Flow Block, it is standard for the portions of the dispensing device to have a flow channel with one entrance and one exit end. That is, to have only two openings to the outside of the dispensing device portion. The Flow Block is unique in that it has an additional channel in fluid communication with the flow channel for the purpose of delivering gas under pressure to a fluid pumping through the flow channel. Therefore, it is common for the flow channel of the Flow Block to have three openings to the outside of the Flow Block: one proximate to the flow regulator flow channel, one proximate to the mixing block flow channel and one through which gas is pumped. The gas channel may physically extend into the structure of the Flow Regulator and, hence, be defined by the Flow Regulator. Such an orientation is useful, for example, so that the trigger of the Flow Regulator can control flow through both the flow channel and gas channel simultaneously. However, the gas channel does not intersect the flow channel in the Flow Regulator so the flow channel still has only one entrance and one exit in the Flow Regulator.

The Fluid Transport Medium (FTM) defines a flow channel and serves to deliver fluid to the rest of the dispensing device. The FTM can be flexible (for example, a flexible tubing or hose) or can be rigid (for example, rigid tubing or pipe). Alternatively, the FTM can be a combination of flexible and rigid components. Flexible components are desirable because they provide some amount of surge capacity to aid in dampening flow pulsations when using a pulsating pump, such as a piston pump. Fluid is generally pumped through the FTM to the Flow Regulator and into the rest of the dispensing device.

The Flow Regulator (FR) defines a flow channel in fluid communication with the flow channel of the FTM and serves to control the flow of fluid through the dispensing device, typically by opening or closing off the flow channel through which the fluid travels through the FR. Commonly, the flow regulator is in the form of a gun with a trigger, the trigger controlling whether the flow channel is open (for example, when a user pulls on the trigger) or closed off (for example, when the user releases the trigger). The trigger of the FR can be a conventional trigger as on a spray gun (for example, a lever pulled by a finger) but should not be restricted to such a manifestation. The trigger may be anything that reversibly opens and closes the flow channel. For example, the trigger may be in the form of a button, valve or switch that opens a gate in the flow channel. Desirably, the trigger is located upstream relative to liquid flow from a gas channel (discussed below) that is used to introduce pressurized gas into liquid traveling through the dispensing device. In a particularly desirable embodiment the FR is an airless spray gun, particularly those that are commercially available.

The Flow Block (FB) defines a flow channel in fluid communication with the flow channel of the FR and is removably attached to the FR. The FB is removably attached to the FR so that when the device is intended to dispense a foamed fluid the FB can be attached to the FR and when the device is intended to dispense a non-foamed fluid the FB can be removed.

The FB actually defines two channels, the flow channel that extends all the way through the FB from one end of the FB to an opposing end of the FB and a gas channel that extends from outside the FB to the FB flow channel. The gas channel provides fluid communication between the outside of the FB and the flow channel and serves as a pathway for introducing gas under pressure into a fluid flowing through the FB flow channel. When dispensing a fluid through the device of the present invention with a desire to foam that fluid, introduce a pressurized gas through the gas channel and into the fluid. The gas supplied through the gas channel is under pressure and can be controlled by including an optional valve (for example, a needle valve) in the gas channel. In one embodiment, the trigger on the flow regulator controls both the flow of liquid through the flow channel and the flow of gas through the gas channel. Desirably, a check valve is present in the gas channel to prevent liquid from traveling down the gas channel and contaminating the pressurized gas and/or components along the gas channel (for example, pressure gauges).

At the interface of the FR and FB is a Flow Restriction Orifice (FRO). The FRO resides in the flow channel and serves to restrict the flow of fluid between the FR and FB, thereby building up backpressure of fluid in the flow channel prior to the FB and reducing the pressure of the fluid in the FB. Desirably, the combination of pump setting, FTM (or other upstream) surge capacity and FRO opening size is such that the desired flow rate can be obtained without an undesirable pulsation in the fluid flow when using a piston pump to pump the fluid through the dispensing device. The pressure drop through the FRO must be adequate to reduce the pressure in the FB to below the gas pressure of the gas being introduced into the fluid through the gas channel downstream from the FRO relative to fluid flow.

The FRO can be part of the FB and reside at the beginning of the FB flow channel or can be a separate piece that resides just inside the FR, just inside the FB or at the interface of the FR and FB. One of ordinary skill in the art understands the exact position of the FRO is not important as long as it restricts the flow between the FR and FB.

Desirably, the combination of pump setting and FRO opening size (opening cross sectional area) is such that the fluid pressure in the FR is 2.8 Mega Pascals (MPa) or greater (400 pounds per square inch (psi) or greater). If the pressure is below 2.8 MPa there can be an undesirable pulsation in the fluid flow when using a piston pump to pump the fluid through the dispensing device. Creating higher pressures using a constriction in the flow channel (for example, the FRO) creates a reservoir of fluid that can work to dampen pulsations in the fluid from the pump. An upper pressure limit is not critical and is usually moderated depending on target flow rate of the fluid through the dispensing device.

The FRO has an opening in it to allow fluid communication between the FR and FB flow channels. The opening size (cross sectional area) in the FRO is smaller than the cross sectional area of the flow channel in the FR and much smaller than the cross sectional area of the flow channel in the FB. Fluid flows forcefully through the FRO and then reduces in pressure as it fills the larger flow channel in the FB. Select the size of the flow channel through the FB (cross sectional dimension and length) based on desired fluid pressure in the FB channel and the desired flow rate of fluid through the dispensing device. The fluid pressure in the FB must be below the gas pressure of the gas being introduced into the fluid through the gas channel. The flow rate of the fluid through the FB flow channel should achieve a target flow rate for the fluid through the dispensing device. For fine application of foamed fluid a target flow rate of 50 grams per minute (g/min) can be desirable. Generally, the target flow rate is 50 g/min or greater and more typically is 100 g/min or greater, 200 g/min or greater, 300 g/min or greater, or even 400 g/min or greater. Usually, the target flow rate is concomitantly 600 g/min or less in order to maintain controlled flow.

Selection of the exact sizes of the FRO opening as well as FR and FB flow channels are a function of viscosity of the formulation pumping through the flow channel of the device. One of ordinary skill in the art can readily determine appropriate sizes to obtain the necessary back pressure in the FR flow channel and appropriate pressure and target flow rate in the FB flow channel.

The mixing block (MB) defines a flow channel extending all the way through the MB from one end to an opposing end, the MB flow channel being in fluid communication with the FB flow channel. The MB flow channel contains mixing elements, typically static mixing elements, that serve to mix the gas into the fluid. Desirably, the mixing elements are sufficient in number and efficiency so as to disperse the gas sufficiently to form enough bubble sites to achieve stable foam at a desired density. It is further desirable for the mixing elements to disperse the gas into a monomodal bubble size distribution—that is, a distribution that does not have two different obvious maxima with a large bubble size and another smaller bubble sized. The number of mixing elements and length of the MB depends on the selection of mixing elements. For example, use of highly efficient mixing elements may require fewer elements than less efficient mixing elements. In selecting mixing elements it is important to consider the backpressure generated by the mixing elements and ensure that it does not exceed the pressure of gas introduced into the fluid in the FB or backflow of the fluid into the gas channel will occur unless a check valve is present in the gas channel to prevent such backflow.

Desirably, the amount of gas introduced into the liquid and the extent of mixing (extent of bubble sites) is sufficient to achieve foam from the dispensing device that has a density of 0.2 grams per cubic centimeter (g/cc) or less, preferably 0.17 g/cc or less. Concomitantly, the density of the foam from the dispensing device is preferably 0.05 g/cc or more, more preferably 0.1 g/cc or more so as to have sufficient integrity upon deposition to allow for application of a non-foamed coating soon after foam deposition. Foam densities below 0.05 g/cc are possible, but tend to be unstable foam that can relatively easily collapse.

The MB can be permanently affixed to the FB or be removably affixed to the FB. In a desirable embodiment, the MB is removably affixed to the FB so that mixing elements can be removed from the MB flow channel to be cleaned or replaced periodically. Examples of suitable mixing elements include packed bead beds, as well as helical and cross-blade static mixer inserts (for example, HME and GXF mixing inserts available from StaMixCo).

The optional, though preferred, stabilization block (SB) of the dispensing device defines a flow channel extending all the way through the SB from one end to an opposing end, the SB flow channel being in fluid communication with the MB flow channel. A stabilization block is desirable in order to produce and dispense stable foam (stable from collapse) from the dispensing device. Foam dispensed in an absence of the SB tends to be unstable to collapse. Such unstable foam can be desirable, but for other applications such as for dispensing a stable foam insulating sealant into cracks on a surface it can be undesirable.

The SB can be permanently affixed or be removably attached to the MB. One purpose of the SB is to allow the fluid/gas mixture to expand to form essentially stable foam having a density equal to or proximate to that of the foam expelled from the dispensing device onto a substrate. Typically, this expansion occurs as the pressure of the fluid/gas mixture reduces in the SB flow channel. In one embodiment, the fluid/gas mixture in the flow channel will gradually reduce in pressure from the pressure in the MB to a pressure at or close to the pressure desired for application of the fluid to a substrate. In a desirable embodiment the SB flow channel is of constant dimensions throughout the SB. In another desirable embodiment, the SB flow channel diverges, getting larger in cross sectional area the further away from the MB. Desirably, the SB flow channel is free from step changes in cross sectional area that can induce explosive changes in pressure and foam density of the fluid/gas mixture.

Figure 2:
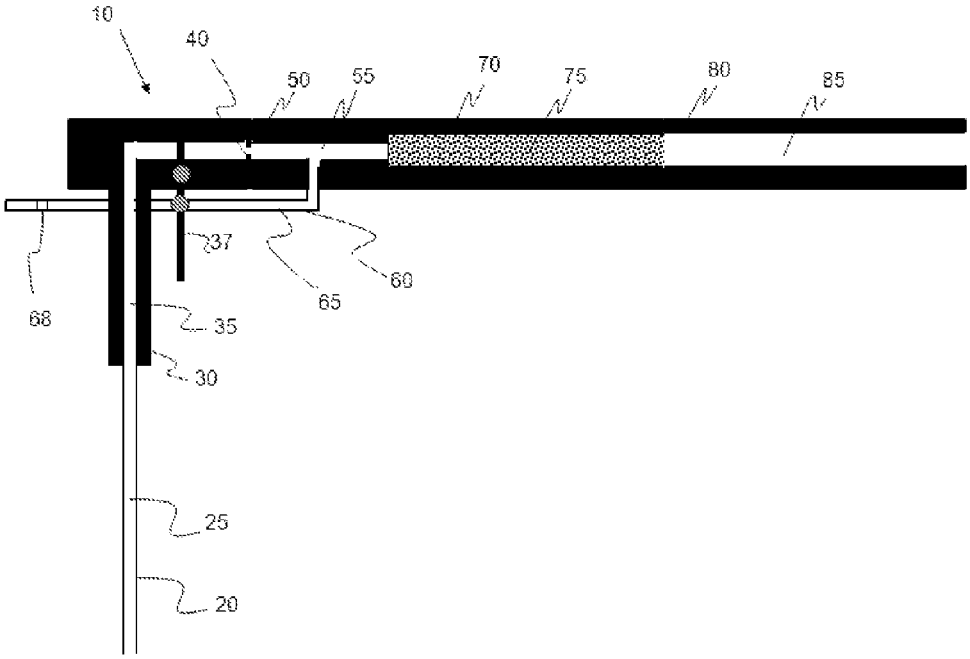
FIG. 2 illustrates a general cross sectional view of an alternative embodiment of the dispensing device of the present invention.

To help illustrate the dispensing device of the present invention, FIG. 1 illustrates a general cross sectional view of dispensing device 10, an embodiment of the present invention. Fluid transport medium 20, with flow channel 25 serves to provide fluid to flow regulator 30, which defines flow channel 35. Fluid flow through flow channel 35 is regulated by trigger 37, which is shown in a closed position (blocking flow of fluid). When trigger 37 is in an open position to allow flow of fluid through flow channel 35, fluid continues through flow restriction orifice 40 into flow block 50 and flow channel 55. Gas is pumped into the liquid in flow channel 55 by means of gas channel 65 defined by nipple 60 and through check valve 68; gas flow can be controlled via a needle valve (not shown). Fluid continues from flow channel 55 into mixing block 70 and its flow channel 75. Flow channel 75 contains mixing elements such as a packed bead bed (not labeled). From flow channel 75 the liquid flows into stabilization block 80 and extension block 85 where the gas expands in the liquid to form a foam prior to exiting extension block 85 and dispensing device 10. Further, FIG. 2 depicts an alternative embodiment, which is the same a FIG. 1, except that trigger 37 on the flow regulator 30 controls both the flow of liquid through the flow channel 55 and the flow of gas through the gas channel 65.

Optionally, the dispensing device further comprises an extension block (EB). The EB defines a flow channel extending entirely through the EB from one end to an opposing end. The EB flow channel, when the EB is present, is in fluid communication with the SB flow channel. The purpose of the EB is to extend the reach of the dispensing device to enable application of fluid (or foam) from the dispensing device to hard to reach substrate locations. The EB can be permanently affixed or removably attached to the SB.

The dispensing device can further comprise a pump that pumps the fluid under pressure through the flow channel of the dispensing device (that is, through the flow channels of each element of the dispensing device). Any pump suitable for pumping fluid is suitable, though a piston or diaphragm pump is common.

One aspect of the present invention is a process for dispensing both foamed fluid and non-foamed fluid using the dispensing device of Claim 1.

The FB, FRO, and MB are necessary components for producing and dispensing foamed liquid with the dispensing device and the SB is optional but desirable. However, none of the FB, FRO, MB or SB components are necessary for dispensing non-foamed liquid with the dispensing device. The FB is removably attached to the FR, allowing removal of the FB, and all subsequent components, from the FR to convert the dispensing device from a foam dispensing device to a fluid spray, roller or brush applicator (or vice versa). Desirably, upon removing the FB from the FR a spray nozzle, roller or brush is removably attached to the nozzle of the FR to control and define the type of fluid application (for example, wide spray, circular spray, even stream application, rolling application or brushing application). To switch between fluid application and foam application either add or remove the FB, FRO, MB and, if present, SB and, if present, EB to/from the FR and either remove or add a spray nozzle from/to the FR and then pump the desired fluid through the FTM and through the dispensing device.

The process for first dispensing a foam and then a liquid coating, as is desirable for LBW applications, comprises the following steps: (i) pumping a foamable fluid through the flow channel of the device—the flow channel of each of FR, FB, MB, SB (if present) and EB (if present) while simultaneously injecting gas into the foamable fluid through the gas channel so as to form a foamable fluid composition; (ii) dispensing the foamable fluid composition as a foam from the SB, or if present, EB onto a substrate (which can be, for example, a crevice between building overlayment boards); (iii) disconnecting the removably attached FB, with the MB and, if present, SB and, if present, EB (along with FRO) from the FR; (iv) optionally removably attaching a spray nozzle to the flow regulator (a); and (v) pumping a second fluid through the FR and, if present, the spray nozzle and dispense the fluid onto a surface. Desirably, the fluid forms a non-foamed coating over the surface.

Suitable fluids for use with the present dispensing device are any fluid suitable for foaming (when applying foam) or suitable for spray coating in the form of anything from a mist to a stream when non-foaming. Typically, the fluid is some form of a latex formulation. The formulation used to prepare and dispense foam can be the same or different from the formulation used to dispense non-foam.

The device of the present invention is well suited to efficiently applying a foamed material and a non-foamed material in any sequence with the same dispensing device. Such a device makes application of LBWs much more efficient than having to use one dispensing device for foam and another for the liquid overcoat.

The following example illustrates an embodiment of the present invention.

Examples 1-5

Foamed Water

Prepare a foaming formulation consisting of 96 weight-parts water, two weight-parts sodium lauryl sulfate (29 wt % solids in water) and two weight-parts ammonium stearate (35 wt % in water).

To a Graco™ Magnum X-7 paint sprayer (Graco is a trademark of Graco Minnesota Inc.) attach to the spray gun (acting as a flow regulator):

(a) a flow block having a 3.175 millimeter (0.125 inch) diameter flow channel intersecting with a similar diameter air flow channel through which air flow is regulated by a needle valve;

(b) a flow restriction orifice between the flow regulator and flow block (Bird Precision part number RB-82742-.015 having a 0.381 millimeter (0.015 inch) opening) creating a fluid pressure in the FR of 2.8 mega Pascals (MPa) or greater (400 pounds per square inch or greater), (c) a mixing block (12 millimeter diameter channel extending through the mixing block and packed with StaMixCo model GXF mixing elements; Mixing blocks of five different lengths were used with four different stabilization block options, as indicated in Table 1); and (d) a stabilization block (8 millimeter (5/16 inch) diameter channel through the stabilization block extending 81 centimeters (32 inches)).

TABLE 1

| Example | MB Length (cm) | SB Length (cm) | Flow Rate g/min | Foam Density g/cm$^3$ |
|---|---|---|---|---|
| 1 | 25 | 0 | 688 | 0.13 |
| 2 | 5 | 91 | 648 | 0.11 |
| 3 | 25 | 45 | 640 | 0.06 |
| 4 | 40 | 80 | 640 | 0.03 |
| 5 | 70 | 80 | 660 | 0.04 |

Pump the foam formulation through the dispensing device at a flow rate as shown in Table 1. Introduce compressed air at a pressure of 483 kiloPascals (70 pounds per square inch) into the foam formulation using the gas channel in the flow block. Apply the foam to a wooden wall. Example 1 produced foam that when dispensed on the wall to a 6 mm thickness did not sag for 30 minutes. By two hours it had dried to a thin film. Example 4, in contrast, can be applied 30 mm thick to the vertical wooden wall and it will not sag over two hours.

Flow one gallon or more of water through the dispensing device to clean it of foaming formulation. Remove the flow block, flow restriction orifice and mixing block from the spray gun.

Example 6

Foamed Acrylic Gap Filler

Prepare a foaming formulation containing 75.9 weight-parts acrylic latex (Rhoplex® EC-1791, 55 wt % solids; Rhoplex is a trademark of Rohm and Hass Company), 19.6 weight-parts water, 1.8 weight-parts sodium lauryl sulfate (29 wt % solids) and 2.7 weight-parts ammonium stearate (35 wt % solids).

Pump the formulation through a device similar to that of Example 4 at a flow rate of 650 g/min (0.11 g/cm$^3$). Dispense the resulting formulation as foam to 0.6 centimeter wide gaps between oriented strand board panels on a building structure and allow to dry for three hours. Apply a non-foam coating over the dried foam using the non-foam formulation application as follows.

Non-Foamed Formulation Application

Prepare a non-foaming coating formulation having the formula described in Example 16 of US patent application publication US2009/0107611A1.

Remove the flow block, flow restriction orifice, mixing block and stabilization block from the spray gun (flow regulator). Attach a Graco RAC-5 spray tip of size 519 to the spray gun of the Graco Magnum X-7 paint sprayer. Following the guidelines for using the paint sprayer to apply paint coating, apply a coating of the non-foaming formulation over the oriented strand board and foam mentioned above. The dispensing device applies the non-foaming formulation at a rate of approximately 750 g/min flow rate. Apply a coating that is 0.76 to one millimeter thick when wet, which dries to a coating thickness of 0.38 to 0.51 millimeters (15-20 mils) when dry. As a result of the non-foamed formulation application the finished wall has a continuous coating over its entire outer surface, both the oriented strand boards and the foam-treated gaps between the oriented strand boards.

These examples illustrate one embodiment of the present invention and illustrate the versatility of the present invention in dispensing frothed foam and a non-foamed coating without having to use two dispensing devices.

The invention claimed is:

1. A dispensing device comprising in order the following members that together define a single flow channel through the dispensing device:

(a) a fluid transport medium defining a flow channel through which liquid can be pumped;

(b) a trigger controlled liquid flow regulator defining a flow channel in fluid communication with the flow channel of the fluid transport medium, where one end of the flow regulator and its flow channel is attached to the fluid transport medium and through which fluid may flow when the trigger is in one position and liquid cannot flow when the trigger is in another position;

(c) a flow block defining a flow channel in fluid communication with the flow channel of the flow regulator and removably attached to the flow regulator, the flow block further defining a gas channel fluidly connecting the flow channel to an inlet defined by a removable additional gas delivery channel in fluid communication with the flow channel of the flow block that delivers gas under pressure to the flow channel and through which gas is introduced under pressure and at a pressure greater than the pressure of the fluid in the flow block to a fluid flowing through the flow channel;

(d) a flow restriction orifice either defined in the flow channel of the flow block or held in place as a distinct piece in the flow channel at the end of the flow regulator, at the start of the flow block or between the flow block and flow regulator, the flow restriction orifice having an opening that is smaller in cross sectional area than the flow channel downstream from it in the flow block;

(e) a mixing block defining a flow channel in fluid communication with the flow channel of the flow block, the mixing block flow channel containing mixing elements;

(f) a stabilization block defining a flow channel in fluid communication with the flow channel of the mixing block where the flow channel in the stabilization block is characterized by an absence of step changes in cross sectional dimensions and by inducing a gradual pressure drop along its length in a fluid being pumped through the flow channel of the dispensing device, wherein the stabilization block defines a flow channel of sufficient dimensions and shape such that foaming of a liquid through the flow channel is completed prior to exiting the stabilization block; and (g) an extension block defining a flow channel in fluid communication with the flow channel of the stabilization block.

2. The dispensing device of claim 1, wherein the flow regulator is an airless spray gun.

3. The dispensing device of claim 1, wherein the flow channel of the stabilization block diverges, getting larger in cross sectional area proximate to the extension block.

4. The dispensing device of claim 1, wherein the extension block is reversibly attachable to the flow regulator or to a spray nozzle attached to the flow regulator so that the flow channel of each of the extension block, flow regulator and, if present, the spray nozzle are in fluid communication with one another.

5. The dispensing device of claim 1, wherein each of (a)-(g) are removably attached to one another.

6. The dispensing device of claim 1, wherein the mixing elements of mixing block (d) are removable from the flow channel of the mixing block.

7. The dispensing device of claim 1, further comprising a liquid pump that can pump fluid under pressure through the flow channels of (a)-(e), (f), and (g).

8. The dispensing device of claim 1, wherein the flow block (c) further comprises a needle valve in the gas channel that regulates gas flow through the gas channel.

9. The dispensing device of claim 1, wherein the flow regulator is an air-assisted spray gun with the gas line attachment point located to the flow block and single trigger that controls both the flow of liquid and gas.

10. A process for dispensing both foamed fluid and non-foamed fluid using the dispensing device of claim 1, the method comprising the following steps:

(i) pumping a foamable fluid through the flow channel of each of (a)-(e), (f) and (g), while simultaneously injecting gas into the foamable fluid through the gas channel of the flow block to form a foamable fluid composition;

(ii) dispensing the foamable fluid composition as foam onto a substrate;

(iii) disconnecting the removably attached flow block from the flow regulator;

(iv) optionally removably attaching a spray nozzle to the flow regulator (a); and (v) pumping a second fluid through the flow regulator and, if present, spray nozzle and dispensing the fluid onto a surface.

11. The process of claim 10, wherein the flow regulator is an airless spray gun and no air is introduced into the flow channel prior to the flow block.

12. The process of claim 10, wherein the spraying device is further characterized by comprising the extension block and wherein foaming of a liquid through the flow channel is completed prior to exiting the stabilization block.

13. The process of claim 10, wherein the foam is dispensed into crevices of a surface while the non-foamed coating is applied over at least a portion of the same surface and at least a portion of the foam.

14. The process of claim 10, wherein the fluid flow rate for both the foamable fluid and the second fluid is 500 grams per minute or greater.

15. The process of claim 10, wherein the foam has a density of 0.2 grams per cubic centimeter or less and 0.1 gram per cubic centimeter or more.

16. The process of claim 10, wherein the flow regulator is an air-assisted spray gun with the gas line attachment point located to the flow block and single trigger that controls both the flow of liquid and gas.

* * * * *